US005992532A

United States Patent [19]

Ramsey et al.

[11] Patent Number: 5,992,532

[45] Date of Patent: Nov. 30, 1999

[54] WET PIPE FIRE PROTECTION SYSTEM

[75] Inventors: John B. Ramsey, Grand Rapids; James G. Retzloff, Lansing, both of Mich.

[73] Assignee: The Viking Corporation, Hastings, Mich.

[21] Appl. No.: 09/132,579

[22] Filed: Aug. 11, 1998

[51] Int. Cl.[6] ..... A62C 37/36

[52] U.S. Cl. ..... 169/46; 169/17; 169/61

[58] Field of Search ..... 169/18, 43, 46, 169/60, 61, 56; 251/30.01; 137/487.5

[56] References Cited

U.S. PATENT DOCUMENTS

| | | | |
|---|---|---|---|
| 3,235,860 | 2/1966 | Vassil | 169/28 |
| 3,750,161 | 7/1973 | Teeters | 340/418 |
| 3,788,400 | 1/1974 | Tufts | 169/11 |
| 3,865,192 | 2/1975 | Dunphy | 169/9 X |
| 4,258,795 | 3/1981 | Hansen | 169/19 |
| 4,305,469 | 12/1981 | Morrisette | 169/61 |
| 4,359,098 | 11/1982 | Johnson | 169/90 |
| 4,368,782 | 1/1983 | Bray | 169/90 |
| 4,741,403 | 5/1988 | Nishimura | 169/61 |
| 4,923,013 | 5/1990 | De Gennaro | 169/90 |
| 5,303,778 | 4/1994 | Vari | 169/90 |
| 5,720,351 | 2/1998 | Beukema et al. | 169/61 |

OTHER PUBLICATIONS

"Model SCB Timer for use with Fire Cycle II system" by The Viking Corporation, Aug. 1984.

"Firecycle II System Changes" by The Viking Corporation, May 8, 1980.

"Firecycle II Automatic On–Off Sprinkler System (Modification)" by the Viking Corporation, Jun. 17, 1987.

"Firecycle System Development" by The Viking Corporation, Mar. 23, 1967.

*Primary Examiner*—Kevin Weldon

*Attorney, Agent, or Firm*—Van Dyke, Gardner, Linn & Burkhart, LLP

[57] ABSTRACT

The fire suppression system includes a system piping, with at least one sprinkler, a flow control valve, a fire suppressant delivery line in fluid communication with the flow control valve, at least one fire detector adapted to detect temperatures associated with fire, and a control system. The control system is in communication with the fire detector, the flow control valve and the system piping. The control system is adapted to detect a flow condition and a no-flow condition in the system piping and actuates the flow control valve between a normally open condition and a closed condition when the fire detector is in a no-fire condition state and the control system detects a flow condition in the piping system and may cycle the flow control valve to open when the flow control valve is closed in response to the fire detector being in a fire condition state.

22 Claims, 6 Drawing Sheets

| | NO TIMER STAYS ON CONSTANTLY | 30 SECONDS | 60 SECONDS | 90 SECONDS | 2 MINUTES | 5 MINUTES | 10 MINUTES | 15 MINUTES |
|---|---|---|---|---|---|---|---|---|
| SWITCH 3 | OFF | OFF | OFF | OFF | ON | ON | ON | ON |
| SWITCH 4 | OFF | OFF | ON | ON | OFF | OFF | ON | ON |
| SWITCH 5 | OFF | ON | OFF | ON | OFF | ON | OFF | ON |

FIG. 5

ACTION

L=LATCH A=ALARM T=TROUBLE
K=TRACK N=NORMAL S=SUPERVISORY

| | INPUT CIRCUITS | TYPE | OPEN | ELOR | SHORT | OUTPUT CIRCUITS | | | | | | RELAY MODULE NOTE 2 | | | | | |
|---|---|---|---|---|---|---|---|---|---|---|---|---|---|---|---|---|---|
| | | | | | | ALARM BELL | AUX SUPERVISORY BELL | RELEASE SOLENOID 1 | RELEASE SOLENOID 2 | ALARM RELAY | TROUBLE RELAY | DETECTION RELAY | SUPERVISORY RELAY | RELEASE 1 RELAY | RELEASE 2 RELAY | ALARM RELAY | TROUBLE RELAY |
| 1 | DETECTOR CIRCUIT 1 | K/1 | A | A | N | K | | 1 | K | K | T | L/K | | 1 | L/K | L/K | T |
| 2 | MANUAL PULL | K/1 | T | N | A | K | | 1 | K | K | T | L/K | | 1 | L/K | L/K | T |
| 3 | WATER FLOW ALARM | L | T | N | A | L | | | L | | T | L | | | L | | T |
| 4 | SUPERVISORY | L | T | N | S | | L | | | | T | | L | | | | T |
| 5 | ALARM ACTIVATE SWITCH | L | | | | L | | | | L | | L | | | | L | |

FIG. 6

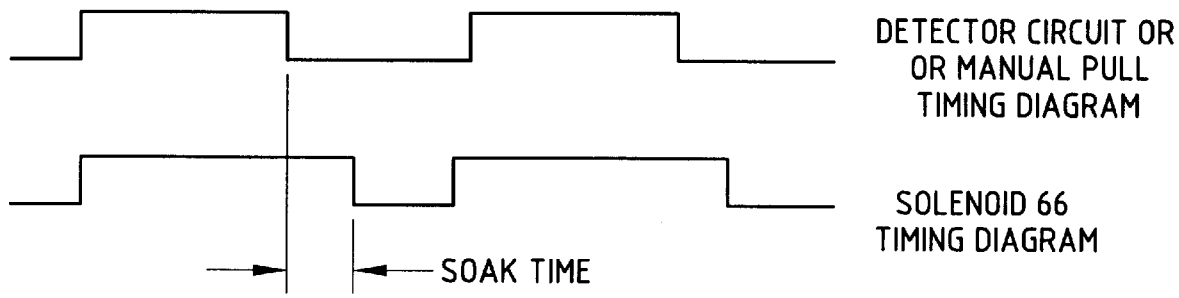

WET PIPE FIRE PROTECTION SYSTEM

TECHNICAL FIELD AND BACKGROUND OF THE INVENTION

The present invention relates to a fire suppression system and, more particularly, to a fire suppression system in which fire suppressant, such as water, remains in the piping system and yet the system controls the amount of fire suppressant or water which can escape from the system in the event of damage to the sprinklers or the system piping.

Conventional water based fire suppression systems include "wet pipe", "dry pipe", "single-interlocked preaction", and "double-interlocked preaction" systems. The dry pipe and preaction systems are normally dry, but once activated, permit the water based fire suppressant to enter the fire suppression network of piping and sprinklers. However, since the systems are normally dry, the response time can be significantly longer than wet pipe systems. Preaction systems are normally preferred over wet pipe and dry pipe systems because they minimize the risk of water damage in the event that the fire suppression network of pipes or sprinklers are damaged. Therefore, when water based fire suppression systems are installed in commercial or residential areas, where water damage can result in extensive property damage, preaction systems are typically employed.

On the other hand, wet pipe systems are filled with water and, therefore, upon triggering of the respective sprinkler heads, water is immediately dispersed by the sprinkler heads to the location of the fire. In addition, the use of fast response type sprinklers is preferred and may be limited to wet pipe systems. Consequently, wet pipe systems have a significantly shorter response time than dry pipe systems. However, in the event that a sprinkler head is damaged or a pipe in the network of pipes is damaged, as mentioned above, extensive water damage can occur.

Consequently, there is a need for a wet pipe fire suppression system which can provide a quick response and yet can avoid the extensive water damage that is associated with conventional wet pipe systems.

SUMMARY OF THE INVENTION

According to the present invention, a fire suppression system includes system piping, at least one sprinkler mounted to the system piping, a flow control valve in fluid communication with the system piping and having a normally open condition whereby the system piping is normally filled with the fire suppressant, the fire suppressant delivery line in fluid communication with the flow control valve and delivering fire suppressant to the flow control valve, at least one fire detector adapted to detect temperatures associated with the fire, and a control system which includes a flow detector. The control system is in communication with the fire detector, the flow control valve and the system piping and is adapted to detect a flow condition and a no-flow condition in the system piping through the flow detector. The control system is further adapted to actuate the flow control valve between its normally open condition and a closed condition when the fire detector is in a no-fire condition state and the control system detects a flow condition in the system piping and to actuate the flow control valve to open when the flow control valve is closed in response to the fire detector being in the fire condition state.

In other aspects, a flow detector is coupled to the system piping and to the control system. The flow detector generates and transmits a flow condition signal to the control system, which cycles the flow control valve closed when the fire detector detects a no-fire condition state and the flow detector generates a flow condition signal. The flow condition signal indicates that water is flowing from the system piping and/or from one or more sprinklers, such as in the case where there has been damage to the system. In this manner, the flow control valve shuts off and prevents fire suppressant from entering the system piping and sprinklers to minimize water damage during a non-fire condition.

In other aspects, the flow control valve includes an inlet chamber, an outlet chamber, a priming chamber, and a clapper assembly. The inlet chamber and the outlet chamber are separated from the priming chamber by the clapper assembly. The flow control valve further includes a priming line in fluid communication with the inlet and the priming chamber, which pressurizes the priming chamber. The clapper assembly opens and closes the valve in response to pressure in the priming chamber. Preferably, the control system controls the flow from the priming line to the priming chamber to open and close the flow control valve.

In further aspects, the priming line includes at least one solenoid valve. The control system actuates the solenoid valve to open and close to control the flow of the fire suppressant through the priming line to thereby control the flow control valve. Preferably, the priming line includes a second solenoid valve, with one of the solenoid valves comprising a normally closed solenoid valve and the other comprising a normally open solenoid valve to control the flow of fire suppressant in the priming line. The control system actuates the normally open solenoid valve to close and the normally closed solenoid valve to open to fully open the flow control valve in response to the detector being in a fire condition state. However, after a fire and the fire detector is in no-fire condition state, the control system actuates the normally closed solenoid valve to close while the normally open solenoid valve remains closed to thereby close the flow control valve. In this manner, the system can be drained and any necessary repairs performed. Optionally, the control system includes a timer which measures a preselected soak period. The control system actuates the normally closed valve to close after the soak period, if any, has elapsed.

Accordingly, a method of controlling the flow of fire suppressant through a fire suppression system to system piping includes providing a normally open flow control valve, coupling the flow control valve to a fire suppressant supply and to system piping, filling the system piping with fire suppressant, detecting a no-fire condition and a no-flow condition in the system piping, detecting the flow of fire suppressant through the system piping, actuating the normally open flow control valve to close when a no-fire condition is detected and flow is detected in the system piping, and actuating the flow control valve to reopen or remain open when a fire condition is detected.

In further aspects, the flow control valve includes an inlet chamber, an outlet chamber, a priming chamber, and a clapper assembly. The inlet chamber and the outlet chamber are separated from the priming chamber by the clapper assembly. The flow control valve further includes a priming line in fluid communication with the inlet and the priming chamber. The flow of fire suppressant is controlled by controlling the flow of fire suppressant through the priming line to open and close the flow control valve.

As will be understood, the fire suppression system of the present invention provides a wet pipe system which is controlled in a manner to avoid extensive water damage should any of the pipes or sprinklers of the piping system be damaged. Consequently, the present invention provides a quick response fire suppression system without any of the disadvantages of a conventional wet pipe system. These and other objects, advantages, purposes, and features of the invention will become more apparent from a study of the following description taken in conjunction with the drawings.

DESCRIPTION OF THE DRAWINGS

FIG. 5 is a release panel function table of the control panel of FIG. 4;

FIG. 6 is a timing diagram for the control panel of FIG. 4;

DETAILED DESCRIPTION OF THE PREFERRED EMBODIMENTS

Figure 1:
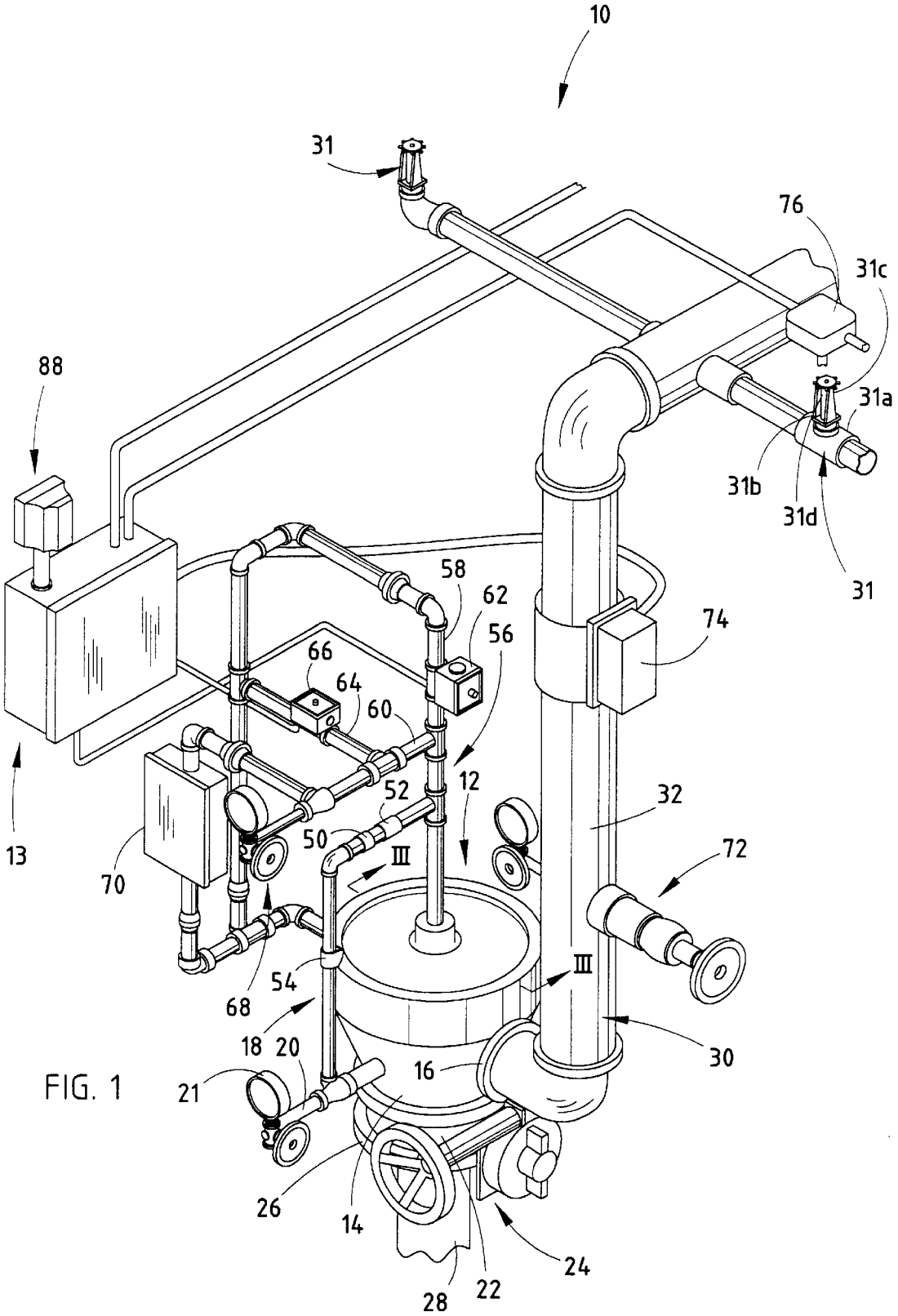
FIG. 1 is a perspective view of the fire suppression system protection of the present invention.
Figure 2:
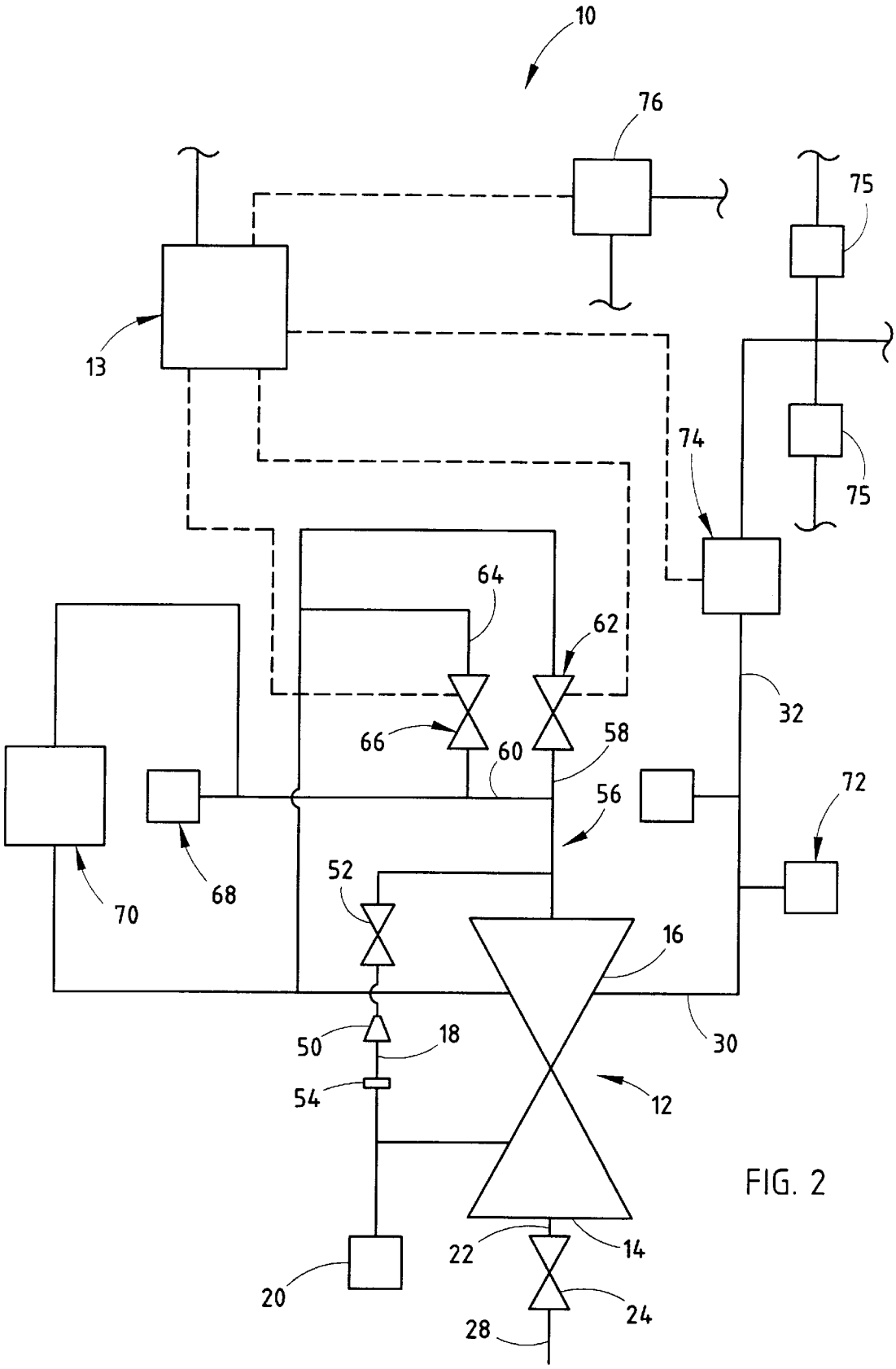
FIG. 2 is a schematic piping drawing of the fire suppression system of FIG. 1.

Referring to FIGS. 1 and 2, the numeral 10 generally designates a fire suppression system of the present invention. Fire suppression system 10 includes a flow control valve 12 which includes an inlet 14, an outlet 16, and a priming line 18. Priming line 18 includes a pressure gage line 20 and a pressure gage 21, which monitors the pressure in the supply system. Inlet 14 of control valve 12 is coupled and in fluid communication with an outlet 22 of a water supply control valve 24, which in turn includes an inlet 26 which is coupled to and in fluid communication with a fire suppressant supply line, such as a water supply line 28. Outlet 16 of control valve 12 is coupled to and in fluid communication with a system pipe 30 and, preferably, with a system pipe riser 32. System piping 30 has one or more sprinklers 31, preferably heat activated sprinklers such as those commercially available from The Viking Corporation of Hastings, Mich. As will be more fully described below, fluid control valve 12 controls the flow of fire suppressant, such as water, from water supply line 28 to system piping 30.

Figures 3, 7:
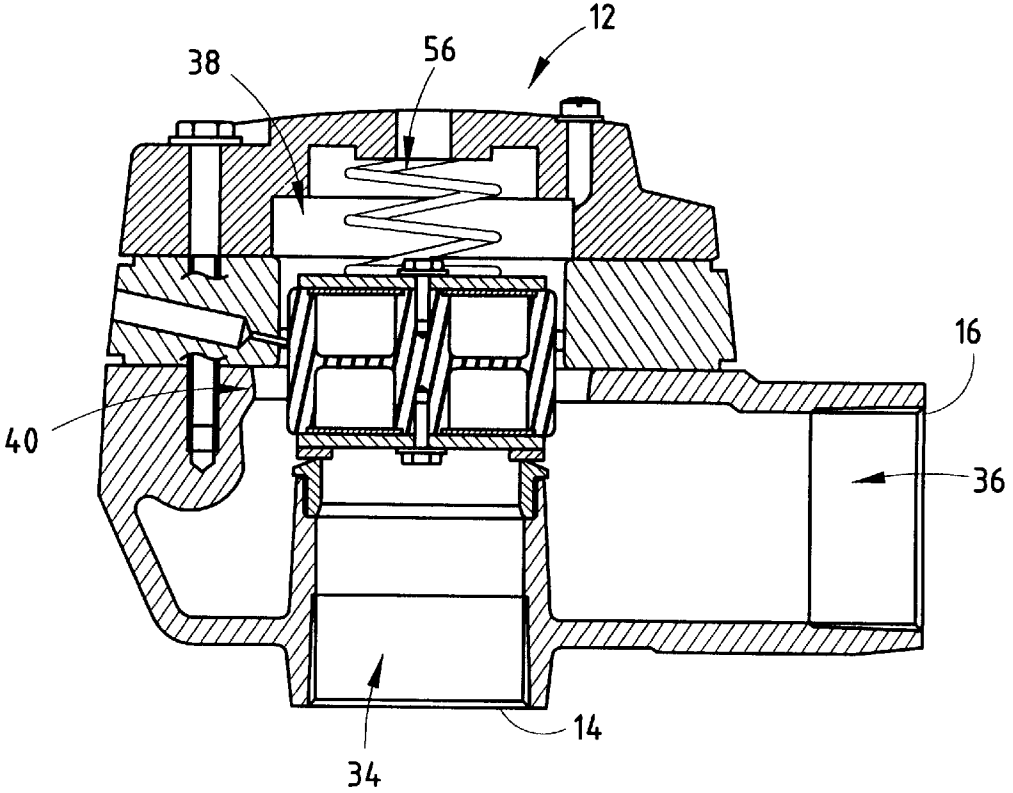
FIG. 3 is cross-sectional view taken along line III—III of FIG. 1.
FIG. 7 is a table of switch positions for a soak-timer of the control panel of FIG. 4.

Control valve 12 preferably comprises a flow control valve such as a flow control valve commercially available under the model H-1 from the Viking Corporation of Hastings, Mich. Referring to FIG. 3, control valve 12 includes an inlet chamber 34, an outlet chamber 36, and a priming chamber 38. Inlet chamber 34 and outlet 36 are separated from the priming chamber 38 by a diaphragm and clapper assembly 40. Water is delivered to the priming chamber 38 through priming line 18 from inlet chamber 34. Priming line 18 is restricted by a restricted orifice 50 and is equipped with a check valve 52 to control the flow of fire suppressant through priming line 18. Preferably, priming line 18 further includes strainer 54. The fire suppressant supply pressure, which is delivered by priming line 18 to priming chamber 38, along with the pressure provided by a spring 56 in valve 12, causes clapper assembly 40 to seal inlet chamber 34.

Referring again to FIGS. 1 and 2, priming line 18 is in fluid communication with a trim line 56. Trim line 56 includes a first branch line 58 and second branch line 60. First branch line 58 includes a first electrically actuated solenoid valve 62, which is normally open and discharges to outlet 16 of flow control valve 12. Second branch line 60 includes a cross-branch line 64 to first branch line 58. Cross-branch line 64 includes a second electrically actuated solenoid valve 66, which is normally closed. First solenoid valve 62 permits the system water supply pressure which enters priming chamber 38 of flow control valve 12 to escape so that flow control valve 12 will not set and instead will remain open to fill system piping 30 with water. When down stream pressure exceeds the supply pressure, however, flow control valve operates as a hydraulic operated check valve to prevent reverse flow.

Second branch line 60 is in fluid communication with the first branch line 58 and ties first branch line 58 up stream of solenoid valve 62 between solenoid 62 and priming line 18. Cross branch line 64 ties back into first branch line 58 down stream of solenoid valve 62. Preferably, second branch line 60 includes a priming pressure water gage and a valve 68 for monitoring the water pressure in trim line 56 and priming chamber 38. Additionally, second branch line 60 includes an emergency release 70 which provides manual control of flow control valve 12.

Second solenoid valve 66, which is normally closed, is used in conjunction with first solenoid valve 62 to control the flow of water through flow control valve 12. When solenoid valve 62 is open, the pressure is released from the priming chamber 38 of flow control valve 12 faster than it is resupplied through the restricted priming line 18. Consequently, the water supply pressure and the inlet chamber 34 forces the clapper assembly 40 to open allowing water to flow from inlet chamber 34 to outlet chamber 36 and into piping system 30.

As described above, outlet 16 of valve 12 is coupled to a riser pipe 32 of system piping 30. Riser pipe 32 includes a system drain 72, which permits the system piping to be optionally drained of water after the system is operated. In order to monitor the flow of fire suppressant through system piping, riser pipe 32 preferably includes a flow detector 74, for example a water flow alarm switch, or a pressure switch, or the like. When activated, flow detector 74 generates and transmits flow condition signals to control panel 13 which selectively energizes normally open solenoid valve 62 to close, thus, closing flow control 12, as will be more fully described in reference to the system operation description provided below.

Control panel 13 is in communication with first and second solenoid valves 62 and 66 to selectively energize and de-energize the respective solenoid valves to open and close as mentioned above. In addition, control panel 13 is in communication with one or more fire detectors 76 and, optionally, with one or more manual pulls 77, which are located in a detection area. Fire detector 76 may include, for example, conventional heat or smoke detectors, which preferably comprise close contact detectors that open to signal an alarm. For example, detectors 76 may comprise FIRE CYCLE™ detectors commercially available from The Viking Corporation. Preferably, detectors 76 are chosen to have detection temperatures lower than the lowest temperature rated sprinkler being used. Sprinklers 31 are preferably conventional heat triggered sprinklers and include a sprinkler body 31*a* which has an outlet 31*b* and is coupled and in fluid communication with the system piping 30. Sprinkler 31 further includes a frame 31*c* and a temperature sensitive trigger 31*d* which is positioned between the outlet 31*b* and the frame 31*c*, which breaks or releases to open the outlet 31*b* upon detecting temperatures associated with a fire.

Figure 4:
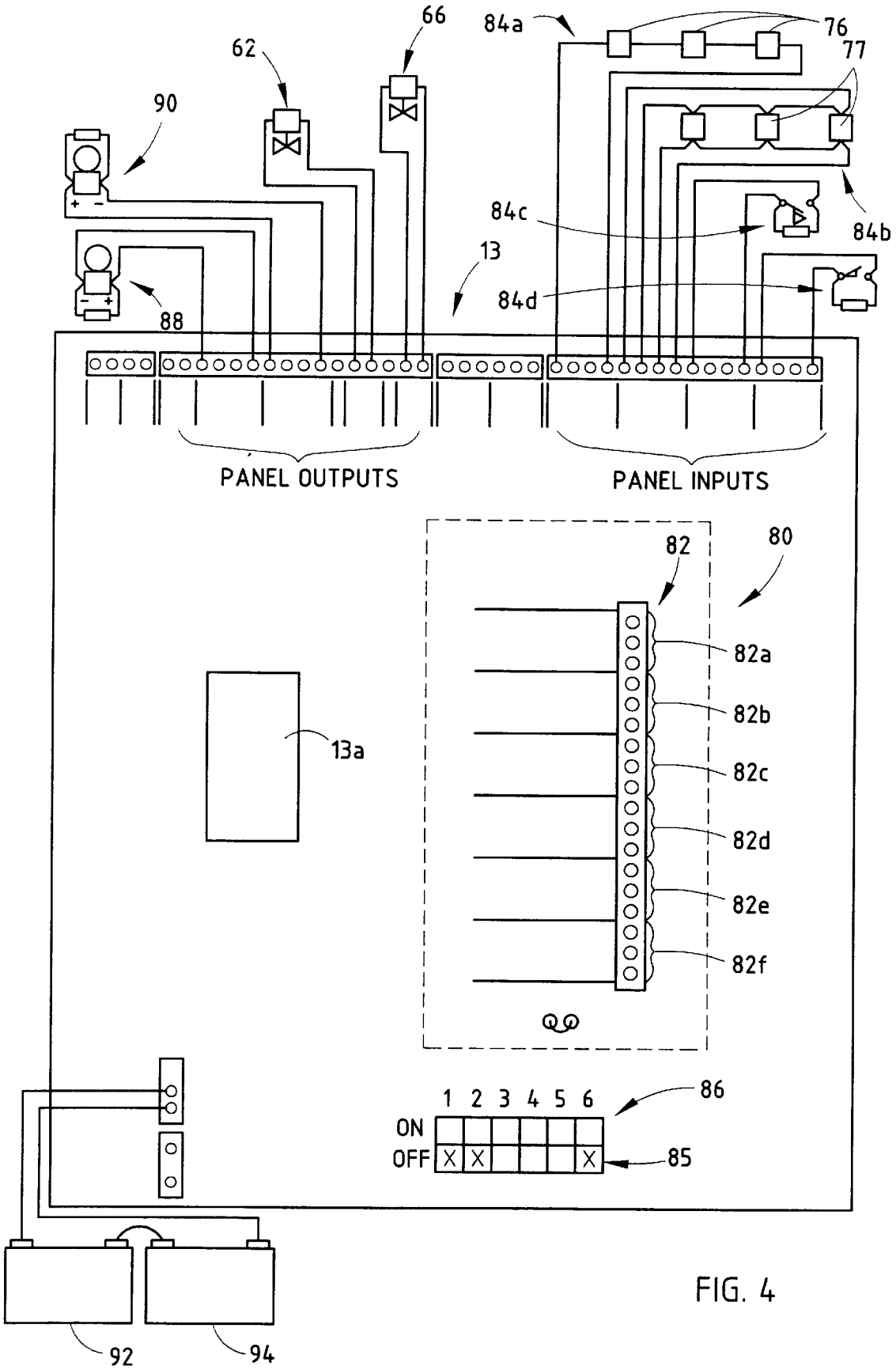
FIG. 4 is a schematic drawing of a control panel of the fire suppression system of FIG. 1.

Referring to FIG. 4, control panel 13 optionally comprises a control panel commercially available under the trademark FIRE CYCLE III™ or PAR 3 from The Viking Corporation. Control panel 13 is a microprocessor controlled releasing panel and includes a microprocessor 13*a* and at least one zone relay 80. Zone relay module 80 preferably comprises a commercially available zone relay module 4XCM part number 07912 from The Viking Corporation of Hastings, Mich. Zone relay module 80 includes six relay contacts 82, namely a detection contact 82*a,* a supervisory contact 82*b,* a release one contact 82*c,* a release two contact 82*d,* an alarm contact 82*e,* and a trouble contact 82*f.* Relay contacts 82 are actuated as follows. Detection relay contact 82*a,* is actuated by any one of a detection circuit 84*a,* a manual pull circuit 84*b,* or a water flow alarm switch circuit 84*c.* Detection circuit 84*a* includes one or more detectors 76. Manual pull circuit 84*b* includes one or more conventional manual pull stations 77 and may, for example comprise a manual pull station available from The Viking Corporation of Hastings, Mich. Supervisory relay contact 82*b* of zone relay module 80 is actuated by a supervisory circuit 84*e.* Release one contact 82*c* is actuated by detection circuit 84*a* or manual pull circuit 84*b,* and optionally tracks the input with a soak timer 85, which is established by a switch 86 on control panel 13. The switch positions are shown in tabular form in FIG. 7, and a preferred timing diagram for soak timer 85 is illustrated in FIG. 6. Release two contact 84*d* is actuated by detection circuit 84*a,* manual pull circuit 84*b,* or water flow circuit 84*c.* Water flow circuit includes water flow alarm switch 74 which may, for example, comprise a water flow alarm switch under the model VSR-F or VSR-D from The Viking Corporation. Alarm relay contact 82*e* is actuated by detection circuit 84*a,* or manual pull circuit 84*b,* or optionally by an alarm switch circuit (not shown). Trouble contact 82*f* is actuated by a panel malfunction or fault in the field wiring.

Again referring to FIG. 4, control panel 13 includes outputs for first and second solenoid valves 62 and 68 and for an alarm bell 88 and, optionally, a remote trouble signal 90. In addition, control panel 13 preferably includes stand-by batteries 92 and 94 so that the control panel 13 will remain operational in the event of a power failure. Furthermore, control module 13 may optionally include a remote enunciator (not shown) which provides indication of an alarm condition, an axillary supervisory condition, a first releasing circuit condition, a second releasing circuit condition, a system trouble condition, and/or a tone silent switch condition. Preferably, the remote enunciator is wired such that any open condition will cause the system trouble condition to be signaled. Furthermore, the remote enunciator optionally includes LED's to indicate the respective conditions. In order to support the remote enunciator, control panel 13 optionally includes a LED interface module (not shown) which monitors open conditions with the enunciator. The LED interface module preferably comprises a commercially available LED interface module part number 07910 or RZA-4X part number 07911 from The Viking Corporation. Zone relay module 80, the enunciator module, and the various supporting circuitry are preferably mounted on common circuit board, for example 110 volt mother board part number 08389 and a 220 volt mother board part number 0839, both commercially available from The Viking Corporation of Hastings, Mich.

SYSTEM OPERATION

Fire suppression system 10 preferably operates as a normal wet pipe system and, thus, immediately discharges water from any sprinklers on the system which have been actuated or operated, such as in a fire. Further, suppression system 10 may have the ability to sense when the fire has been controlled and automatically turn off the water flow after pre-programmed "soak timer" has been satisfied as will be more fully described below. Should the fire rekindle, the fire suppression system 10 will initiate the sequence again. This optional unique cycling feature will continue to operate as long as necessary, provided power is available to the panel. Thus, fire suppression system 10 provides a quick response and, yet, helps minimize water damage, water usage, and the danger of pollution to surrounding areas.

Figure 8:
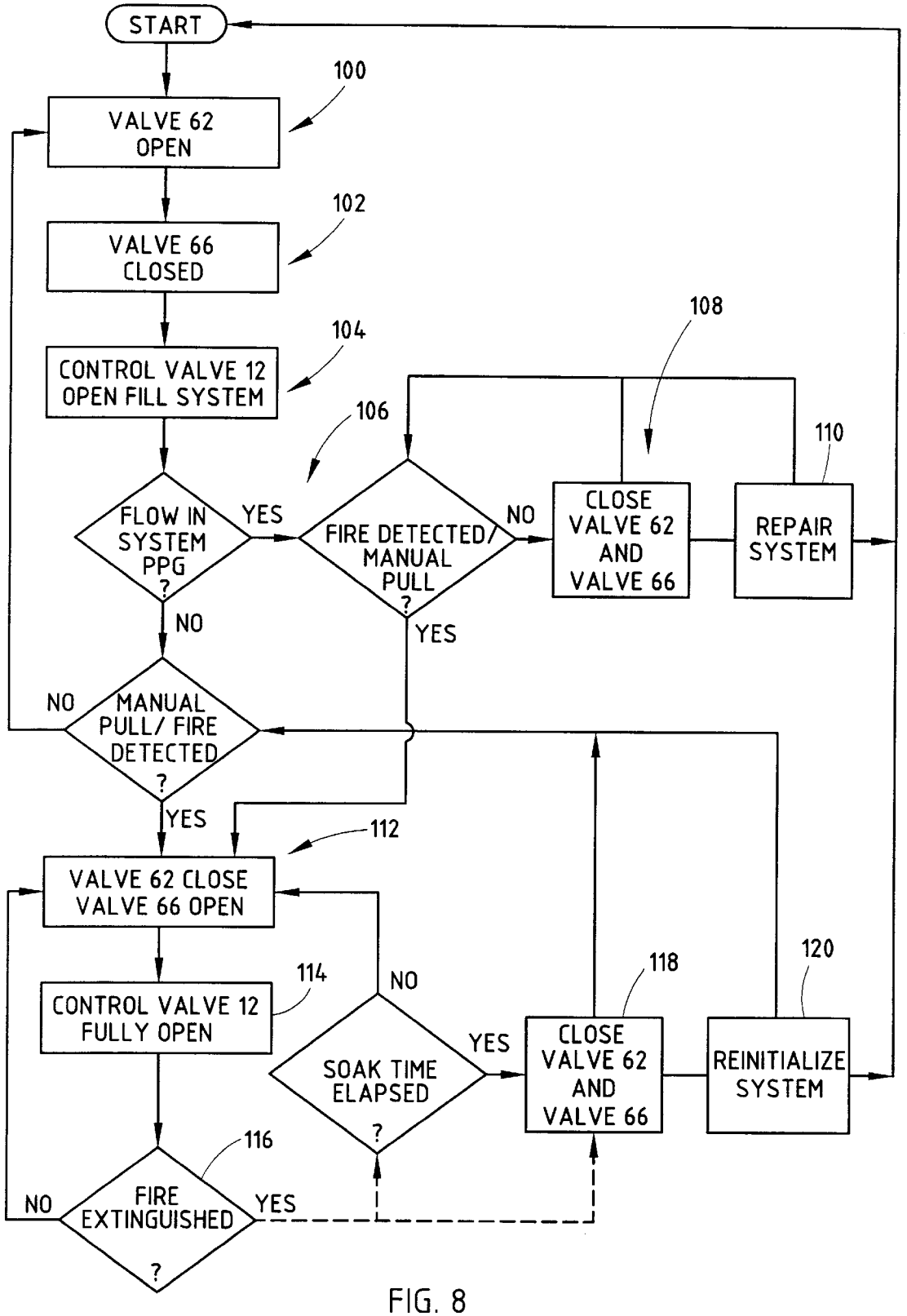
FIG. 8 is a flow chart of the control system of the fire suppression system of FIG. 1.

Flow control valve 12 and release solenoid valves 62 and 66 are controlled by control panel 13. Control panel 13 is activated by detectors 76 and optionally by manual pull stations 77. In a normal operating condition, the water supply enters flow control valve 12 through inlet 14 of flow control valve 12 and the system water also enters priming chamber 38 of control valve 12 through the priming line 18. Referring to FIG. 8, solenoid valve 62 is normally open (100) and solenoid valve 66 is normally closed (102). Solenoid valve 62 allows the primer water to escape from priming chamber 38 so that flow control valve 12 will remain open (104), thereby filling system piping 30 with water. If flow is detected in system piping 30, and detectors 76 do not detect a fire (106), then both solenoid valves 62 and 66 are closed at 108. After appropriate repairs (110), system 10 is restarted and returned to 100. However, when detectors 76 detect temperatures associated with a fire or upon actuation of manual pull stations, control panel 13 energizes normally open solenoid valve 62 to close and energizes normally closed solenoid valve 66 to open (112). Pressure continues to be released from the priming chamber 38 of control valve 12 faster than it is supplied to the restricted orifice 50 in priming line 18 (114). Thus, flow control valve 12 remains fully open to allow water to flow through system piping 30 and to activate alarm devices, including flow detector 74. Therefore, water immediately flows from any sprinklers attached to the system piping 30 which have been actuated or operated. Water flow alarm switch 74 is activated by the flow of water and latches normally open solenoid valve 62 closed. Consequently, water discharges until the fire is extinguished and all the detectors have cooled below their set point and have been reset. After the fire is extinguished and all the detectors have been reset (116), control panel 13 optionally activates the "soak-timer" which allows the system to continue discharging water for a preset time period. After the soak timer has expired, control panel 13 de-energizes the normally closed solenoid valve 66 allowing it to close (118). At this point, solenoid valve 62 remains closed until control panel 13 is manually reset (120). As a result, the pressure in priming chamber 38 increases and control valve 12 closes which stops the flow of water to piping system 30. However, it should be understood that should a detector 76 detect temperatures associated with a fire at this time, control panel 13 re-energizes normally closed solenoid valve 66 open to repeat the cycle.

If the AC power supply to control panel 13 fails, solenoid operated valve 66 remains closed as solenoid operated valve 62 remains latched or energized closed until the backup batteries run out of power. If the battery power fails, solenoid valve 62 fails open and solenoid valve 66 fails closed. Flow control valve 12 will, therefore, open and water will flow from any open sprinklers until the AC power is restored or the system is manually shut down.

After a fire condition, the system piping 30 is preferably drained and any sprinklers which may have been damaged during the fire are replaced. Emergency release valve 70 is then opened to allow the system pressure to return to normal. Once the pressure has been established, the emergency release valve 70 is closed and a system reset button (not shown) provided on the control panel 13 is pressed. Should the detection system be damaged or malfunction, control panel 13 will initiate appropriate alarms and flow control valve 12 will open. However, water will not flow from, any sprinklers until a sprinkler has been operated. If the piping system is damaged sufficiently to activate flow detector 74, control panel 13 will energize normally open solenoid valve to close. However, in this condition, since a detector 76 has not been activated by a fire, solenoid valve 66 will remain energized closed. Consequently, control valve 12 will re-prime and close after a short delay. This sequence ensures that should a sprinkler or a piping system become damaged, the amount of water which is discharged is limited by the system pressure or the location of the system damage. However, should a detector detect a fire during this condition, solenoid valve 66 will be energized open allowing flow control valve 12 to open so that water will be discharged from any sprinklers which may have operated as a result of the fire.

It should be understood from the foregoing, that the fire suppression system of the present invention can provide a quick response and, yet, avoids the extensive water damage associated with conventional piping systems. Furthermore, the fire suppression system of the present invention can operate as a wet pipe system or as a cycling wet pipe system. The flow control valve (12) operates as a check valve for the system and, further, is controlled by solenoid valves 62 and 66. It should be understood, however, that a single solenoid valve may be used to achieve the same control over control valve 12. For example, the single solenoid valve may be configured to be normally open and close when it is desired that flow control valve 12 be closed. However, the addition of the second solenoid valve provides a backup system so that in the event that one of the solenoid valves becomes inoperable, the other solenoid valve can continue to operate the system as described above. In addition, the control system may include pneumatic or hydraulic components and/or logic to actuate the various features of the present fire suppression system.

While one form of the invention has been shown and described, other forms will now become apparent to those skilled in the art. The embodiment of the invention shown in the drawings is not intended to limit the scope of the invention which is defined by the claims which follow.

We claim:

1. A fire suppression system comprising:

system piping;

at least one sprinkler mounted to said system piping, said system piping for delivering fire suppressant to said sprinkler, said sprinkler having an outlet and a temperature sensitive trigger, said temperature sensitive trigger opening said outlet for dispersing fire suppressant when sensing temperatures associated with a fire condition;

a flow control valve having a normally open condition whereby said system piping is normally filled with fire suppressant, said flow control valve for controlling the flow of suppressant to said system piping and sprinkler;

a fire suppressant delivery line in fluid communication with said flow control valve and delivering fire suppressant to said flow control valve;

at least one fire detector adapted to detect temperatures associated with a fire, said fire detector having a no-fire condition state and a fire condition state; and a control system in communication with said fire detector, said flow control valve, and said system piping, said control system being adapted to detect a flow condition and a no-flow condition in said system piping and to actuate said flow control valve between said open condition and a closed condition when said fire detector is in said no-fire condition state and said control system detects a flow condition in said system piping and further actuating said flow control flow valve to open when said flow control valve is closed in response to said fire detector being in said fire condition state.

2. The fire suppression system according to claim 1, wherein flow control valve includes an inlet chamber, an outlet chamber, a priming chamber, and a clapper assembly, said inlet chamber and said outlet chamber being separated from said priming chamber by said clapper assembly, said flow control valve further including a priming line in fluid communication with said inlet and said priming chamber, said priming line pressuring said priming chamber, and said clapper assembly opening and closing said valve in response to pressure in said priming chamber, and said control system controlling the flow from the priming line to the priming chamber to open and close said flow control valve.

3. The fire suppression system according to claim 1, said control system including a flow detector, said flow detector coupled to said system piping, said flow detector detecting a flow condition and a no-flow condition in said system piping, and said control system actuating said flow control valve closed when said fire detector detects a no-fire condition and said flow detector detects a flow condition.

4. The fire suppression system according to claim 2, said priming line including at least one solenoid valve, said control system actuating said solenoid valve to open and close to control the flow of fire suppressant through said priming line to thereby control said flow control valve.

5. The fire suppression system according to claim 4, said priming line including a second solenoid valve, one of said first solenoid valve and said second solenoid valve comprising a normally closed solenoid valve and another of said first solenoid valve and said second solenoid valve comprising a normally open solenoid valve to control the flow of fire suppressant in said priming line.

6. The fire suppression system according to claim 5, wherein said control system actuates said normally open solenoid valve to close and said normally closed solenoid valve to open to fully open said flow control valve in response to said detector being in said fire condition state.

7. The fire suppression system according to claim 6, wherein said control system ceases actuation of said normally closed solenoid valve whereby said normally closed solenoid valve closes after a fire and when said fire detectors are in a no-fire condition state and said normally open valve is closed.

8. The fire suppression system according to claim 7, wherein said control system includes a timer, said timer measuring a preselected soak period, and said control system ceasing to actuate said normally closed solenoid valve whereby said normally closed solenoid closes after said soak period has elapsed.

9. The fire suppression system according to claim 2, wherein said primer line includes a restricted orifice for controlling the flow of fire suppressant through said priming line.

10. The fire suppression system according to claim 2, wherein said primer line includes a check valve for controlling the flow of fire suppressant through said priming line.

11. A fire suppression system comprising:

system piping;

at least one sprinkler mounted to said system piping, said system piping for delivering fire suppressant to said sprinkler, said sprinkler having an outlet and a temperature sensitive trigger, said temperature sensitive trigger opening said outlet for dispersing fire suppressant when sensing temperatures associated with a fire condition;

a flow detector coupled to said piping system, said flow detector generating a flow condition signal when said flow detector detects suppressant flowing through said system piping;

a flow control valve in fluid communication with said system piping, said flow control valve having an inlet chamber, an outlet chamber, and a priming chamber, said inlet chamber and said outlet chamber being separated from said priming chamber by a clapper assembly, said flow control valve including a priming line in fluid communication with said inlet and said priming chamber, said priming line pressuring said priming chamber, and said clapper assembly opening and closing said flow control valve in response to pressure in said priming chamber, said priming line being adapted to pressurize said priming chamber whereby said flow control valve has a normally open condition to fill the system piping with fire suppressant;

a suppressant supply line delivering suppressant to said inlet of said flow control valve;

at least one fire detector adapted to detect temperatures associated with a fire, said fire detector having a no-fire condition state and a fire condition state; and a control system in communication with said fire detector, said flow detector, and said priming line, said control system being adapted to control the flow of suppressant in said priming line to cycle said flow control valve between said normally open condition and a closed condition in response to said fire detector being in said no-fire condition state and said flow detector generating a flow condition signal and adapted to control the flow of fire suppressant through said priming line to cycle said flow control valve between said closed condition and said normally open condition when said fire detector is in said fire condition state or when said fire detector is in said no-fire condition state and said flow detector generates a no-flow condition signal.

12. The fire suppression system according to claim 11, wherein said priming line includes at least one solenoid valve, said solenoid valve diverting fire suppressant from said priming line and said priming chamber when in an open condition, said control system actuating said solenoid valve to open and close to control the flow of fire suppressant through said priming line to thereby control said flow control valve.

13. The fire suppression system according to claim 12, wherein said at least one solenoid valve comprises a first solenoid valve and said priming line includes a second solenoid valve, one of said first solenoid valve and said second solenoid valve comprising a normally closed solenoid valve and another of said first solenoid valve and said second solenoid valve comprising a normally open solenoid valve to control the flow of the fire suppressant in said priming line to thereby control said flow control valve.

14. The fire suppression system according to claim 13, wherein said control system actuates said normally open solenoid valve to close and said normally closed solenoid valve to open to fully open flow control valve in response to said fire detector being in said fire condition state.

15. The fire suppression system according to claim 14, wherein said control system actuates said normally closed solenoid valve to close after a fire and when said fire detector is in a no-fire condition state and said normally open solenoid valve is closed thereby closing said flow control valve.

16. The fire suppression system according to claim 6, wherein said control system includes a timer, said timer measuring a preselected soak period, and said control system ceasing to actuate said normally closed solenoid valve whereby said normally closed solenoid closes after a fire and when said fire detector is in a no-fire condition state and said normally open solenoid valve is closed after said timer measures said soak period.

17. The fire suppression system according to claim 11, wherein said primer line includes a restricted orifice for controlling the flow of fire suppressant through said priming line.

18. The fire suppression system according to claim 11, wherein said primer line includes a check valve for controlling the flow of fire suppressant through said priming line.

19. A method of controlling the flow of fire suppressant through a fire suppression system to system piping, said method comprising the steps of:

providing a flow control valve;

coupling the flow control valve to a fire suppressant supply and to system piping, the flow control valve having a normally open condition;

filling the system piping with fire suppressant through the normally open valve;

detecting a no-fire condition and a flow-condition in the system piping;

detecting the flow of fire suppressant through the system piping;

actuating the flow control valve to close when a no-fire condition is detected and flow is detected in the system piping; and actuating the flow control valve to re-open or remain open when a fire condition state is detected.

20. The method according to claim 19, wherein said detecting a no-fire condition and a fire-condition includes:

providing a fire detector, the fire detector adapted to detect temperatures associated with a fire, and the fire detector having a no-fire condition state and a fire condition state; and detecting said no-fire condition state and a fire-condition state in said fire detector.

21. The method according to claim 19, wherein said detecting flow includes:

providing a flow control detector, the flow control detector detecting flow in the system piping and generating a no-flow condition signal when no flow is detected and a flow condition signal when flow is detected; and detecting the no-flow condition signal and the flow condition signal.

22. The method according to claim 19, wherein said providing a flow control valve includes providing a flow control valve having an inlet chamber, an outlet chamber, a priming chamber, and a clapper assembly, the inlet chamber and the outlet chamber being separated from the priming chamber by said clapper assembly, said flow control valve further including a priming line in fluid communication with said inlet and said priming chamber, said actuating said flow control valve to close includes controlling the flow of fire suppressant through said priming line to open and close the flow control valve.

* * * * *

UNITED STATES PATENT AND TRADEMARK OFFICE

CERTIFICATE OF CORRECTION

PATENT NO. : 5,992,532
DATED : November 30, 1999
INVENTOR(S) : John B. Ramsey and James G. Retzloff It is certified that error appears in the above-identified patent and that said Letters Patent is hereby corrected as shown below:

Column 7,
Line 8, please delete "," after "from".

Signed and Sealed this

Twenty-fifth Day of December, 2001

*Attest:*

*Attesting Officer*

JAMES E. ROGAN
*Director of the United States Patent and Trademark Office*